US012595636B2

(12) United States Patent
Bourgault et al.

(10) Patent No.: US 12,595,636 B2
(45) Date of Patent: Apr. 7, 2026

(54) BACK-DRAG BUCKET ACCESSORY

(71) Applicant: BOURGAULT MACHINES INC., Saint Brieux (CA)

(72) Inventors: Gerard F. Bourgault, St. Brieux (CA); Kevin Punk, St. Brieux (CA)

(73) Assignee: BOURGAULT MACHINES INC., Saint Brieux (CA)

( * ) Notice: Subject to any disclaimer, the term of this patent is extended or adjusted under 35 U.S.C. 154(b) by 692 days.

(21) Appl. No.: 17/867,874

(22) Filed: Jul. 19, 2022

(65) Prior Publication Data

US 2024/0026634 A1 Jan. 25, 2024

(51) Int. Cl.
*E02F 3/40* (2006.01)
*E02F 3/43* (2006.01)

(52) U.S. Cl.
CPC ..... *E02F 3/401* (2013.01); *E02F 3/43* (2013.01)

(58) Field of Classification Search
CPC ..... E01H 5/066; E02F 3/401; E02F 3/43
See application file for complete search history.

(56) References Cited

U.S. PATENT DOCUMENTS 2,710,464 A 6/1955 Husting
3,866,342 A 2/1975 Cooper
4,356,645 A 11/1982 Hine et al.
4,521,980 A 6/1985 Solaja
5,819,444 A 10/1998 Desmarais
6,240,660 B1 * 6/2001 Dugas ..... E01H 5/066 37/280
6,425,196 B1 7/2002 Weagley et al.
6,470,604 B1 10/2002 Foster et al.
6,612,050 B2 9/2003 Takeuchi
7,100,314 B1 * 9/2006 Jensen ..... E01H 5/066 37/231
7,412,787 B2 8/2008 Sutton et al.
7,481,011 B2 1/2009 Nesseth
7,543,401 B2 6/2009 Hughes
7,562,473 B2 7/2009 Westendorf et al.
7,584,557 B1 9/2009 Nistler
7,588,092 B2 9/2009 Liebl
7,658,022 B2 * 2/2010 Strait ..... E01H 5/063 37/274
7,743,536 B2 6/2010 Evans et al.
7,779,563 B2 * 8/2010 Mills ..... E01H 5/066 37/232

(Continued)

FOREIGN PATENT DOCUMENTS

WO 2021087612 A1 5/2021

*Primary Examiner* — Saul Rodriguez
*Assistant Examiner* — Brendan P Tighe

(57) ABSTRACT

A bucket for a loader includes a main body and a pair of swing plates pivotably coupled to the main body for defining an exterior collection space for gathering material from the ground surface when operating the bucket in a back-dragging mode. Each swing plate is pivotable relative to the main body between a first position and a second position. When in the first position, the swing plate lower edge is raised above an outer surface of the bottom wall. When in the second position, the swing plate protrudes past the outer surface of the bottom wall, with inwardly directed faces of the swing plates cooperating with an outer surface of a bottom wall of the main body to partially enclose an exterior collection space when back-dragging.

17 Claims, 13 Drawing Sheets

(56) References Cited

U.S. PATENT DOCUMENTS

| | | | | |
|---|---|---|---|---|
| 7,941,947 | B2 | 5/2011 | Stephan | |
| 8,191,288 | B2 | 6/2012 | Weagley et al. | |
| 8,621,769 | B2 | 1/2014 | Weagley et al. | |
| 8,631,596 | B2 | 1/2014 | Tulibaski | |
| 9,243,376 | B2 | 1/2016 | Guggino et al. | |
| 9,708,784 | B2 | 7/2017 | Winter et al. | |
| 9,885,160 | B1 | 2/2018 | Stone | |
| 10,106,942 | B2 | 10/2018 | Roberge | |
| 10,358,782 | B2 * | 7/2019 | Holman | E01H 5/067 |
| 10,584,464 | B2 * | 3/2020 | Armstrong | E02F 3/8157 |
| 10,851,508 | B2 | 12/2020 | Guggino et al. | |
| 2006/0059727 | A1 | 3/2006 | Yoder | |
| 2012/0017473 | A1 * | 1/2012 | Paonessa | E01H 5/062 37/233 |
| 2014/0366406 | A1 * | 12/2014 | Guggino | E01H 5/066 37/270 |
| 2017/0362794 | A1 * | 12/2017 | Heath | E02F 3/962 |
| 2018/0127935 | A1 | 5/2018 | Paonessa | |
| 2018/0354415 | A1 * | 12/2018 | Kamimae | E01H 5/066 |
| 2018/0355569 | A1 * | 12/2018 | Kamimae | E01H 5/061 |

* cited by examiner

BACK-DRAG BUCKET ACCESSORY

FIELD

The teaching disclosed herein relates to systems and methods for clearing material from a ground surface, and more particularly, to a bucket mountable to a loader and configured to operate in a back-dragging mode as well as a forward collection mode.

INTRODUCTION

U.S. Pat. No. 6,240,660 (Dugas) teaches an attachment for use with snow handling equipment such as a snowplow blade or a wheel loader bucket or similar implement. The attachment includes a plate pivotally mounted at each end of the implement and movable between a forwardly projecting horizontal deployed position and a retracted position wherein the plate extends upwardly and does not interfere with normal operation of the implement. In the deployed position the plate is freely pivotal upwards and has a rounded front lower corner so that it can readily ride over curb stones and similar obstacles without damaging the mechanism. According to Dugas, the attachments have the effect of greatly increasing the snow handling capacity of the implement without significantly detracting from its normal utilization.

PCT Patent Pub. No. WO2021/087612 (Vigneault) describes a scraper blade device that is adjustable in width and can be used for cleaning a roadway surface. It includes a main transversal support and an elongated moldboard. The moldboard includes two partially overlapping elongated moldboard units. The scraper blade device also includes a plurality of blade segments that can be tilted with reference to one another to follow profile variations of the roadway surface. According to Vigneault, this allows the efficiency of the cleaning to be preserved even when the scraper blade device becomes very large when fully extended.

SUMMARY

The following summary is intended to introduce the reader to various aspects of the applicant's teaching, but not to define any invention.

In one aspect, a bucket for a loader includes a main body defining an interior collection space for collecting material from a ground surface when operating the bucket in a forward collection mode. The interior collection space is bounded at least in part by a bottom wall having a front edge, a back wall extending upward from a rear edge of the bottom wall, and a pair of laterally spaced-apart side walls. The bottom wall and back wall each extend laterally between the side walls. The bucket further includes a pair of swing plates that are pivotably coupled to the main body for defining an exterior collection space for collecting material from the ground surface when operating the bucket in a back-dragging mode. Each swing plate is pivotably mounted to respective outboard sides of the main body at respective pivot joints located proximate the front edge of the bottom wall of the main body. Each swing plate has a swing plate lower edge that extends rearward from a lower edge front end proximate and below the respective pivot joint, to a lower edge back end. Each swing plate has a swing plate top edge extending rearward from a top edge front end proximate and above the respective pivot joint to a top edge back end. Each swing plate has a swing plate back edge extending between the lower edge back end and the top edge back end.

Each swing plate is pivotable relative to the main body between a first position and a second position. When in the first position, the swing plate lower edge of the swing plate is generally flush with, or raised above, an outer surface of the bottom wall to facilitate aligning the bottom wall with the ground surface when operating the bucket in the forward collection mode. When in the second position, the swing plate protrudes (e.g. downwardly) past the outer surface of the bottom wall for aligning the swing plate lower edge with the ground surface when the bottom wall is inclined relative the ground surface and the front edge is moved backward along the ground surface when operating the bucket in a back-dragging mode, with inwardly directed faces of the swing plates cooperating with the outer surface of the bottom wall to partially enclose the exterior collection space opposite the interior collection space.

In some examples, when in the second position, the swing plate top edge of each swing plate remains above the outer surface of the bottom wall of the main body when the swing plate is in, and moves between, the first and second positions. In some examples, when the swing plate is in the second position, a plate upper marginal portion of the swing plate extending along the swing plate upper edge overlaps a sidewall lower marginal portion of the sidewall extending along the sidewall lower edge.

In some examples, the back wall may have a back wall upper edge spaced above the rear edge of the bottom wall and extending between the first and second sidewalls. In some examples, each sidewall has a sidewall upper edge extending between the front edge of the bucket and the back wall upper edge. In some examples, when in the first position, the swing plate top edge of each swing plate may remain below the respective side wall upper edge when the swing plate is in, and moves between, the first and second positions.

In some examples, when in the first position, the swing plate lower edge may be generally aligned with or spaced above the outer surface of the bottom wall.

In some examples, when viewed in side elevation, each side wall may have a side wall periphery and each swing plate may have a swing plate periphery that is generally contained within the side wall periphery when the swing plate is in the first position to inhibit interference of the swing plate with operation of the bucket in the forward collection mode. In some examples, each swing plate is releasably lockable in the first position.

In some examples, the bucket further comprises a rear guide assembly associated with each swing plate to facilitate holding the respective swing plate in an aligned position parallel to the side wall, each rear guide assembly may be fixed to the side wall near the side wall lower edge, and may have guide surfaces to slidably engage opposed contact surfaces of the swing plate near the swing plate back edge when the swing plate is in and moves between the first and second positions.

In some examples, each pivot joint may comprise a ball joint to permit temporary deflection of the swing plate out of the aligned position to a deflected position for preventing damage to the swing plate upon impact with an obstacle, wherein a lower portion of the swing plate may be displaced laterally outwardly away from the main body when in the deflected position.

In some examples, the swing plate may be biased to the aligned position.

In some examples, the rear guide assembly may include an elastomeric torsion spring for biasing the swing plate to the aligned position.

In some examples, the bucket may further comprise a respective lock mounted to each side wall for releasably retaining the swing plate proximate the respective side wall and in the first position.

In some examples, each lock may comprise a pin translatable between advanced and retracted positions along a lock axis oriented generally parallel to the side wall, the pin may engage a notch in the swing plate back edge when the swing plate is in the first position and the pin is in the advanced position.

In another aspect, a method of operating a loader with a bucket to remove material from a ground surface near a structure includes: a step (a) of tilting the bucket relative to the ground surface so that a bottom wall of the bucket is inclined relative to the ground surface and a front edge of the bottom wall is proximate the ground surface near the structure and the rear edge of the bottom wall is raised above the ground surface, the bucket having a first swing plate and a second swing plate pivotably coupled to opposite first and second sides of the bucket proximate the front edge, wherein tilting the bucket pivots each swing plate relative to the bucket from a first position, in which a swing plate lower edge of each swing plate is generally aligned with a lower surface of the bottom wall, to a second position, in which the swing plate lower edge of each swing plate is aligned with the ground surface and extends rearwardly behind the lower surface of the bottom wall of the bucket.

The method further includes a step (b) of back-dragging the tilted bucket away from the structure, thereby gathering material from the ground surface in an exterior collection space defined by inwardly directed faces of the swing plates and the lower surface of the bottom wall of the bucket.

The method further includes a step c) of releasing the gathered material from the exterior collection space in a gathered material zone, and a step d) of collecting the gathered material in an interior collection space of the bucket by un-tilting the bucket to align the bottom wall of the bucket with the ground surface and driving the loader in a forward direction toward the gathered material zone, wherein the swing plates pivot toward the first position relative to the bucket upon un-tilting the bucket relative to the ground surface.

In some examples, a gravitational force may act on the swing plates to urge the swing plates to pivot relative to the bucket to the second position when the bucket is tilted.

In some examples, step c) may comprise raising the bucket away from the ground surface.

In some examples, steps a) to d) may be repeated until a desired amount of the material has been removed from the ground surface.

In some examples, after the last performance of step c), the swing plates may be releasably locked in the first position to inhibit interference of the swing plates with subsequent operation of the bucket in a forward collection mode.

In some examples, steps a) to c) may be repeated multiple times prior to performing step d).

In some examples, step d) may be repeated multiple times after step c).

DRAWINGS

For a better understanding of the described examples and to show more clearly how they may be carried into effect, reference will now be made, by way of example, to the accompanying drawings in which.

The drawings included herewith are for illustrating various examples of articles, methods, and apparatuses of the teaching of the present specification and are not intended to limit the scope of what is taught in any way.

DESCRIPTION OF VARIOUS EXAMPLES

Various apparatuses or processes will be described below to provide an example of each claimed invention. No example described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an example of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
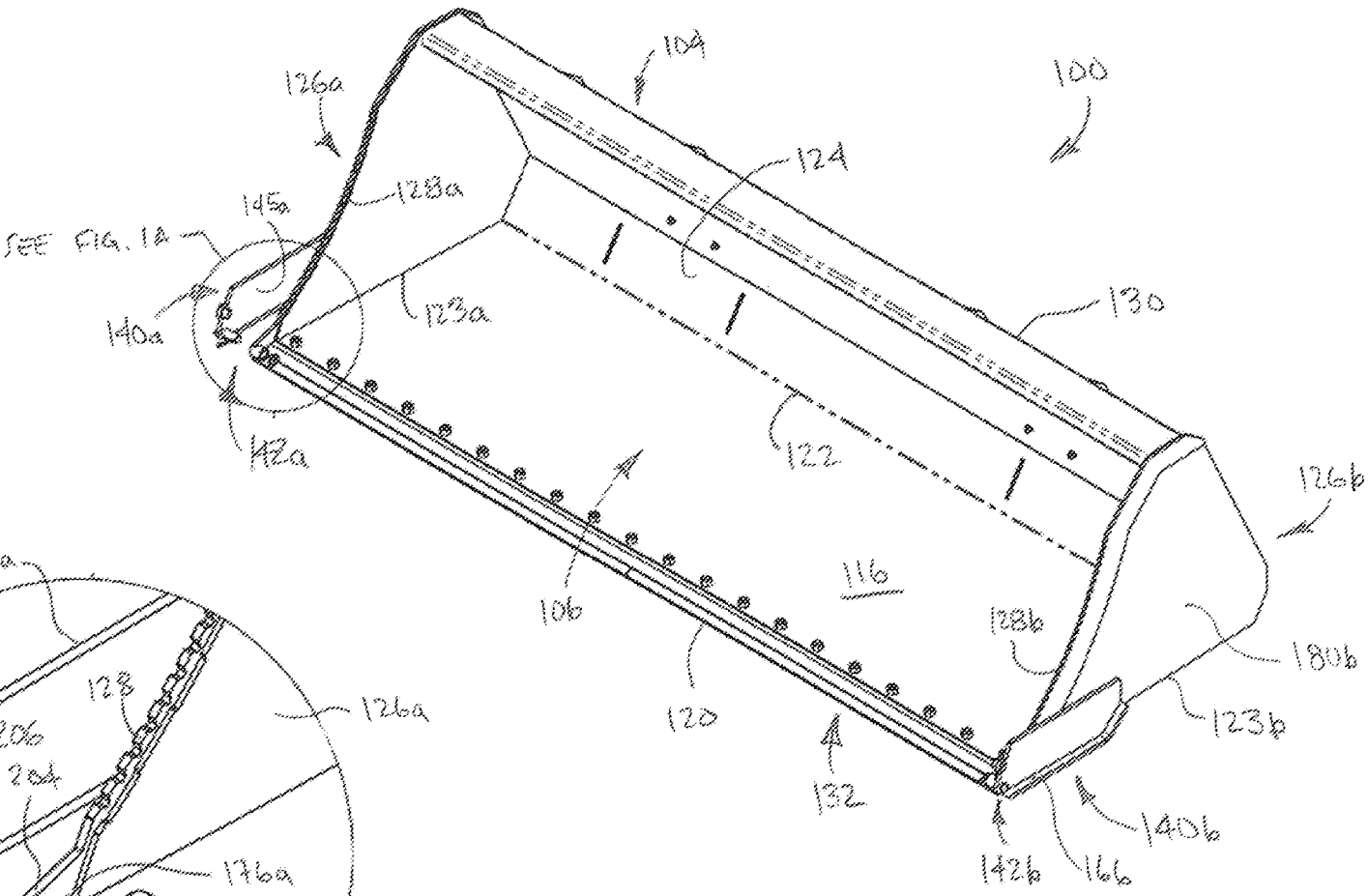
FIG. 1 is a perspective view of an example of a bucket in accordance with aspects of the teaching disclosed herein.

Referring to FIG. 1, an example of a bucket 100 in accordance with one or more aspects of the teaching disclosed herein is illustrated. The bucket 100 is configured to be mounted to a loader. Examples of suitable loaders include, but are not limited to, front-end loaders, wheel loaders, track loaders, skid steers, and tractors.

Figure 3:
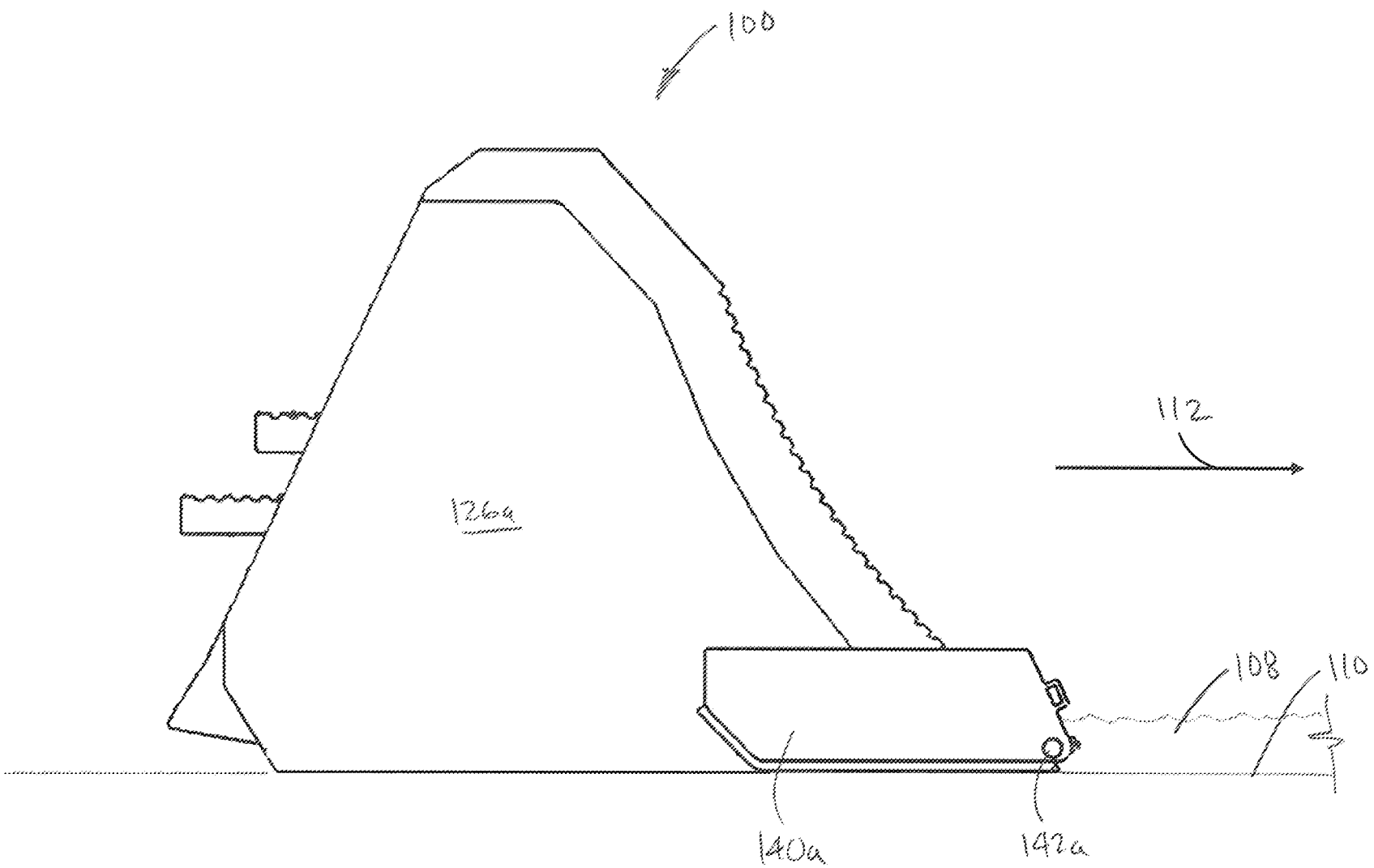
FIG. 3 is a side view of the bucket of FIG. 1, positioned in a forward collection mode with a swing plate proximate a first position.

With reference also to FIG. 3, in the example illustrated, the bucket 100 has a main body 104 defining an interior collection space 106 (FIG. 1) for collecting material 108 (e.g., gravel, dirt, or snow) from a ground surface 110 (FIG. 3) when operating the bucket 100 in a forward collection mode. In the example illustrated, operating the bucket 100 in the forward collection mode includes driving the bucket 100 in the forward direction (arrow 112) to urge material that is ahead of the bucket into the interior collection space 106.

In the example illustrated, the interior collection space 106 is bounded at least in part by a bottom wall 116 extending between a front edge 120 and a rear edge 122, a back wall 124 which extends upwardly from the rear edge 122 of the bottom wall 116, and a pair of laterally space-apart side walls 126*a*, 126*b*. The bottom wall and back wall each extend laterally between the sidewalls (e.g. laterally from the right sidewall 126*a* to the left sidewall 126*b*). In the example illustrated, the side walls extend upwardly from respective lateral side edges 123*a*, 123*b* of the bottom wall 116 and extend between the bottom wall and the back wall. The sidewalls 126*a*, 126*b*, have respective sidewall upper edges 128*a*, 128*b*, and the back wall has a back wall upper edge 130. The back wall upper edge 130 extends between the sidewalls, and in the example illustrated, is generally parallel to the front edge 120. In the example illustrated, the sidewall upper edges 128*a*, 128*b* each extend between the back wall upper edge 130 and the front edge 120.

Figure 2:
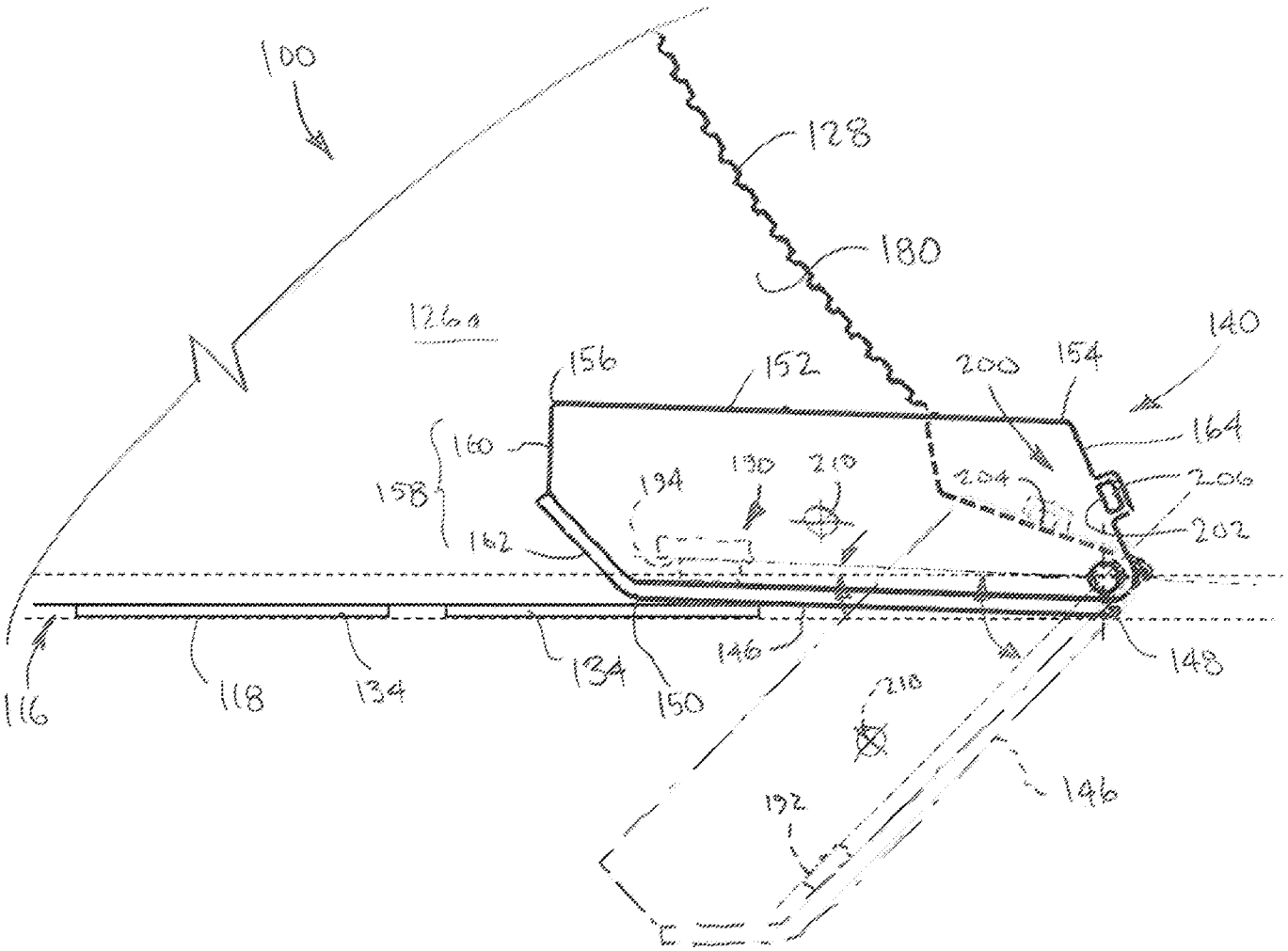
FIG. 2 is a side view of the bucket of FIG. 1, with a swing plate shown in the first position (in solid line) and in the second position (in phantom)

In the example illustrated, the front edge 120 of the bottom wall 116 comprises a replaceable wear strip 132 that is removably secured to the bottom wall of the bucket 100. The bottom wall 116 has an outer (lower) surface 118, and the outer surface 118 may similarly comprise wear pads 134 (see FIG. 2) protruding away from the interior collection space 106.

In the example illustrated, the bucket 100 further includes a pair of swing plates 140*a*, 140*b*, each of which is pivotably coupled to a respective side of the main body 104 of the bucket 100 by a respective pivot joint 142*a*, 142*b*. The swing plates 140*a*, 140*b* operate to at least partially enclose an exterior collection space 144 for gathering material from the ground surface when operating the bucket 100 in a back-dragging mode, as described in greater detail subsequently herein.

In the example illustrated, the swing plate 140*a* (also called right swing plate 140*a*) is mounted adjacent the right sidewall 126*a* of the bucket main body, and the swing plate 140*b* (also called left swing plate 140*b*) is mounted adjacent the left sidewall 126*b* of the bucket main body 104. The right and left swing plates 140*a*, 140*b* are, in the example illustrated, mirror images of each other, and in the following description of the swing plates, the features described for one swing plate are common to the other swing plate.

In the example illustrated, each swing plate 140*a*, 140*b* has a swing plate lower edge 146 that extends rearward from a lower edge front end 148 to a lower edge back end 150. The lower edge front end 148 is, in the example illustrated, near and below the respective pivot joint 142. Each swing plate 140 has a swing plate top edge 152 that extends rearward from a top edge front end 154 to a top edge back end 156. The top edge front end 154 is, in the example illustrated, near and above the respective pivot joint 142. Each swing plate 140 further has a swing plate back edge 158 that extends between the lower edge back end 150 and the top edge back end 156 of the swing plate.

In the example illustrated, each swing plate 140*a*, 140*b* is roughly rectangular in shape, with each swing plate top edge 152 oriented generally parallel to the respective swing plate lower edge 146. The swing plate back edge 158 includes a back edge upper portion 160 that is generally perpendicular to the top edge 152, and an inclined lower portion 162 that slopes forwardly towards the pivot joint 142 with increasing distance from the swing plate top edge 152. The swing plate further includes, in the example illustrated, a swing plate front edge 164 that extends between the lower edge front end 148 and the top edge front end 154. In the example illustrated, the swing plate front edge 164 is inclined relative to the lower and top edges 146, 152, sloping rearward with increasing distance from the swing plate lower edge 146.

In the example illustrated, each swing plate includes a runner 166 extending along the swing plate lower edge 146. The runner 166 has a runner width (in the lateral direction) that is greater than the adjacent plate thickness 170 of the swing plate adjacent the runner, and in the example illustrated, is between about two and about three times the adjacent plate thickness. In the example illustrated, the runner 166 also extends along the inclined lower portion 162 of the swing plate back edge 158.

Figure 1A:
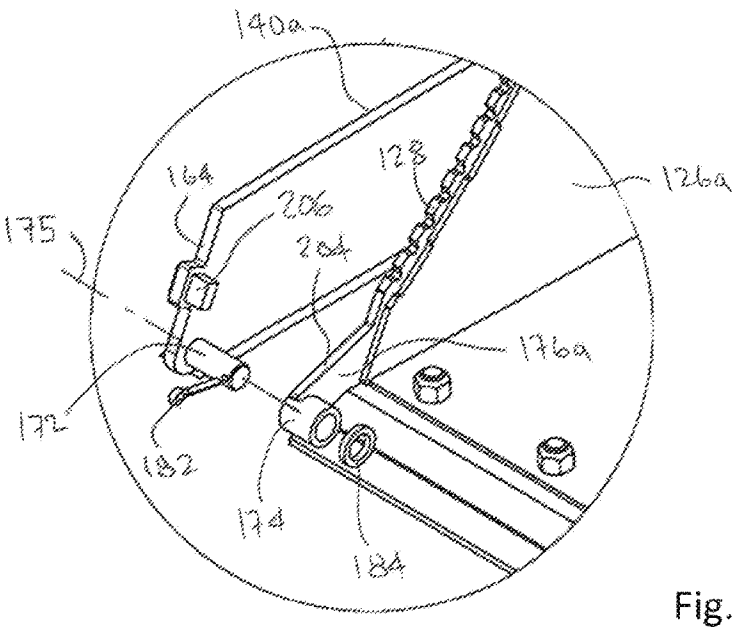
FIG. 1A is an enlarged exploded view of a portion of the bucket of FIG. 1.

Referring again to FIGS. 1 and 1A, each pivot joint 142 comprises a pivot pin 172 that is rotatably received in a bushing 174, and pivotable about a pivot axis 175. The pivot axis 175 is, in the example illustrated, aligned with the lateral direction (generally parallel to the bucket front edge 120). In the example illustrated, the pivot pin 172 is generally cylindrical and is fixed to the respective swing plate proximate the lower edge front end 148, and projects laterally inwardly toward the bucket main body 104. The bushing 174 is, in the example illustrated, fixed to the bucket main body 104 proximate the front edge 120. In the illustrated example, the bushing 174 is fixed to a respective sidewall 126*a*, 126*b* of the bucket. More particularly, each sidewall 126*a*, 126*b* includes a leading projection 176, and the bushing 174 is fixed to the leading projection 176.

Each pivot joint 142 is, in the example illustrated, assembled by positioning an inner surface 178 of the swing plate in facing relation to an outer surface 180 of the bucket sidewall 126, and inserting the pivot pin 172 into the bushing 174. A retainer is provided to prevent unwanted withdrawal of the pin from the bushing. In the example illustrated, the retainer comprises a cotter pin 182 and a washer 184.

With reference again to FIG. 2, each swing plate 140*a*, 140*b* is pivotable relative to the main body 104 between a first position (shown in solid line in FIG. 2) and a second position (shown in phantom line in FIG. 2). When in the first position, the swing plate lower edge 146 is generally raised clear of the lower surface 118 of the bucket bottom wall 116, such that the swing plate lower edge 146 does not protrude past (below) the lower surface of the bucket. In the example illustrated, the lower edge 146 is optionally raised slightly above the bucket lower surface 118 when in the first position. This is facilitated in the example illustrated by providing a first position in which the swing plate is rotated slightly upward (clockwise in FIG. 2) about the pivot axis 175 by about 2 degrees with respect to the horizontal. Providing the ability for each swing plate to move to a position in which the swing plate generally does not protrude downward past the outer surface 118 of the bottom wall 116 of the bucket 100 facilitates positioning the bottom wall 116 proximate to, and in parallel alignment with, the ground surface 110 when operating the bucket 100 in the forward collection mode.

When in the second position, the swing plate lower edge 146 protrudes past the lower surface 118 of the bucket bottom wall 116. In the example illustrated, this is facilitated by providing a second position in which the swing plate is rotated downward (counter-clockwise in FIG. 2) about the pivot axis 175 by between about 35 degrees and about 70 degrees with respect to a reference position (from the horizontal in FIG. 2). Providing the ability for each swing plate to move to a position in which the swing plate protrudes downward past the outer surface 118 of the bottom wall 116 of the bucket 100 facilitates, for example, having the swing plates 140 function as side containment barriers when operating the bucket 100 in the back-dragging mode.

In the example illustrated, each swing plate 140 optionally includes a respective first position stop 190 coupled thereto for fixing the angular position of the swing plate relative to the main body 104 of the bucket 100 when the swing plate is in the first position. The first position stop 190 comprises a first contact surface 192 in generally fixed position relative to the swing plate for bearing against a first abutment surface 194 in generally fixed position relative to the main body 104 of the bucket 100 when the swing plate is in the first position. When the swing plate is in the second position, the first contact surface 192 is spaced apart from the first abutment surface 194.

Each swing plate 140 further comprises, in the example illustrated, an optional second position stop 200 coupled thereto for fixing the angular position of the swing plate relative to the bucket main body 104 when the swing plate is in the second position. The second position stop 200 comprises a second contact surface 202 in generally fixed position relative to the swing plate for bearing against a second abutment surface 204 fixed to the bucket main body 104 when the swing plate is in the second position. In the example illustrated, the second contact surface 202 comprises an underside surface of a lug 206 that is fixed to the swing plate and extends laterally inwardly from the swing plate front edge 164. The second abutment surface 204 comprises, in the example illustrated, a portion of the sidewall upper edge 128 that is laterally aligned with (laterally overlaps) the second contact surface 202 (see also FIG. 1A). When the swing plate is in the second position, the second contact surface 202 (fixed to the swing plate) bears against the second abutment surface 204 (fixed to the bucket main body), and further pivoting of the swing plate relative to the main body 104 in a direction away from the first position is inhibited. When the swing plate is in the first position, the second contact surface 202 is spaced apart from the second abutment surface 204.

In the example illustrated, the first contact surface engages the first abutment surface upon pivoting the swing plate upward (clockwise in FIG. 2) relative to the main body 104 by about 2 degrees from the horizontal or reference position (in which the swing plate lower edge is parallel to the bottom wall 116). Furthermore, in the example illustrated, the second contact surface engages the second abutment surface upon pivoting the swing plate downward (counter-clockwise in FIG. 2) relative to the main body 104 by about 50 degrees from the horizontal or reference position. The total angular travel of swing plate when pivoting from one to the other of the first and second positions is, in the example illustrated, about 52 degrees.

In the example illustrated, each swing plate 140 is biased toward the second position by the force of gravity acting on the swing plate. For example, in cases where the bucket 100 is oriented to have its lower surface 118 generally parallel to, and spaced well above, the ground surface, the swing plate can pivot downward (counter-clockwise as viewed in FIG. 2) to the second position under the force of gravity acting on the swing plate 140. Lowering the bucket toward the ground surface can bring the swing plate lower edge 146 into contact with the ground surface, causing the swing plate to pivot upward (clockwise as viewed in FIG. 2) toward the first position. In the example illustrated, the swing plate lower edge 146 is configured to be aligned with the ground surface 110 during material collection or gathering, and as described in greater detail subsequently herein, tilting and un-tilting the bucket 100 (with the bucket front edge 120 positioned or repositioned proximate the ground surface) can similarly change the position of the swing plates relative to the bucket main body 104 between the first and second positions.

In the example illustrated, the center of mass 210 of the swing plate 140 remains rearward of the pivot axis 175 when the swing plate is moved into and between the first and second positions. This can facilitate desired movement of the swing plates 140 between first and second positions upon adjusting the position of the bucket 100, for example, when changing between forward collection and back-dragging operations.

Referring to FIG. 3, when operating the bucket 100 in the forward collection mode the front edge 120 of the bottom wall 116 is positioned proximate the ground surface 110 from which material 108 is to be collected. The term "proximate the ground surface" includes positioning the front edge 120 in engagement with, or slightly above, the ground surface 110. Engagement of the front edge 120 with the ground surface can facilitate clearing substantially all the material 108 from the ground surface, leaving the ground surface generally bare. Positioning the front edge 112 slightly about the ground surface may leave an acceptably thin layer of material on the ground surface, but can reduce the risk of damaging the ground surface (e.g. by forcefully scraping the front edge along the ground surface) and/or can reduce the risk of damaging the bucket (e.g. by running into asperities projecting slightly upward from the surface being cleared). The bottom wall 116 is, in the example illustrated, aligned generally parallel with the ground surface so that an outer surface 118 of the bottom wall 116, like the front edge 120, is proximate (i.e. engages or is positioned slightly above) the ground surface.

Still referring to FIG. 3, when operating the bucket 100 in the forward collection mode, each swing plate is urged towards the respective first position. In the example illustrated, when the front edge 120 of the bucket 100 is positioned proximate the ground surface to be cleared, contact between at least a portion of the swing plate lower edge 146 and the ground surface urges the swing plate toward the first position relative to the bucket main body. Because the swing plates 140 are free to pivot to a first position in which the swing plates do not protrude past the lower surface 118 of the bucket bottom wall 116, the swing plates 140 do not interfere with lowering the bucket to the desired elevation relative to the ground surface.

Figure 4:
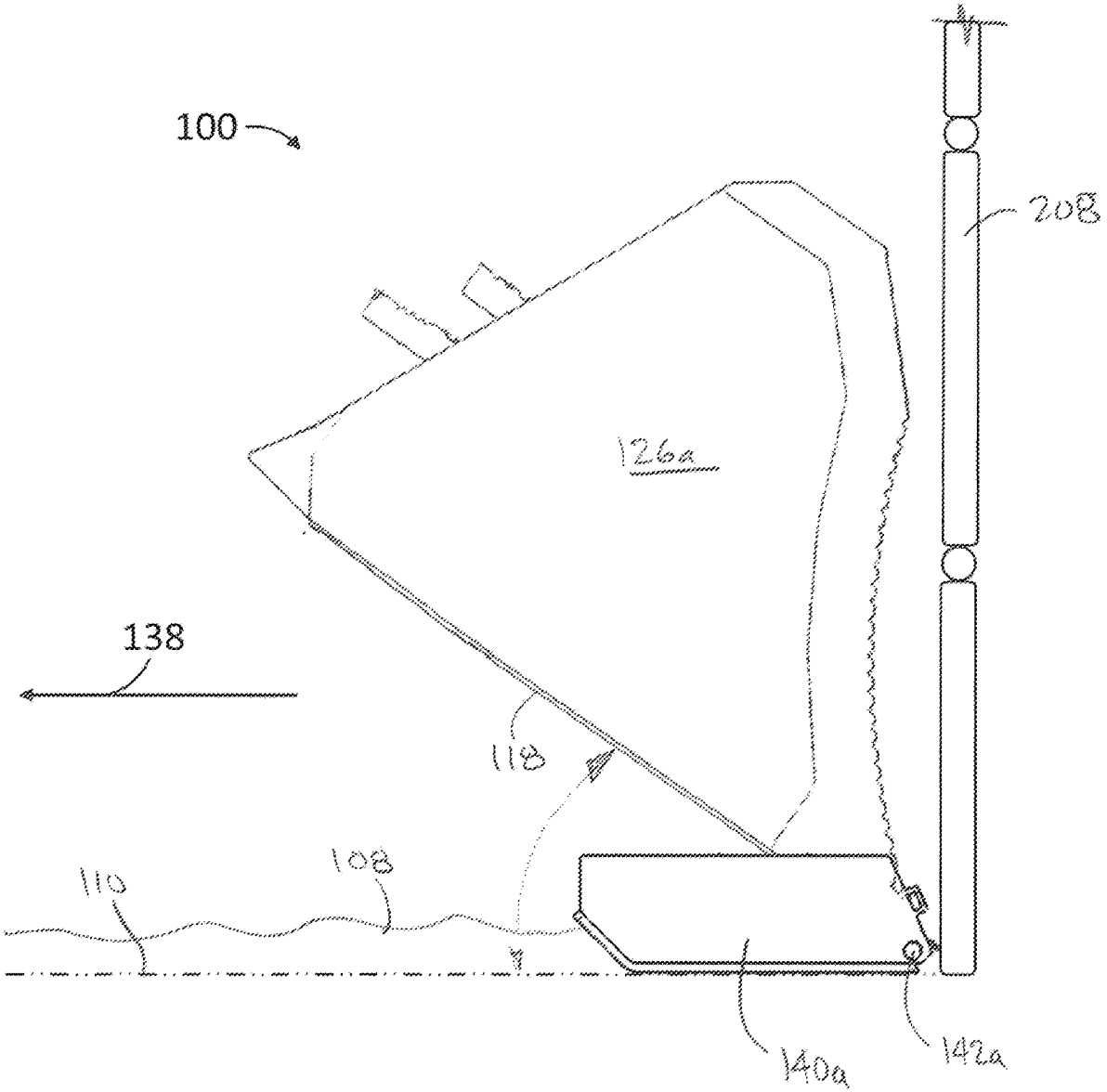
FIG. 4 is a side view of the bucket of FIG. 1, positioned in a back-dragging collection mode with a swing plate proximate a second position.

With reference to FIG. 4, when operating the bucket in the back-dragging mode, the bucket 100 is tilted to move the bucket bottom wall 116 to an inclined orientation relative to the ground surface 110, with the front edge 120 proximate the ground surface 110. The tilt angle at which the bottom wall 116 is inclined relative to the ground surface when the bucket is tilted is generally equal to or less than the angle by which the swing plate pivots downward relative to the bucket main body when moving from the reference position (from the horizontal in FIG. 2) to the second position. In the example illustrated, the tilt angle is about 45 degrees.

Figure 5:
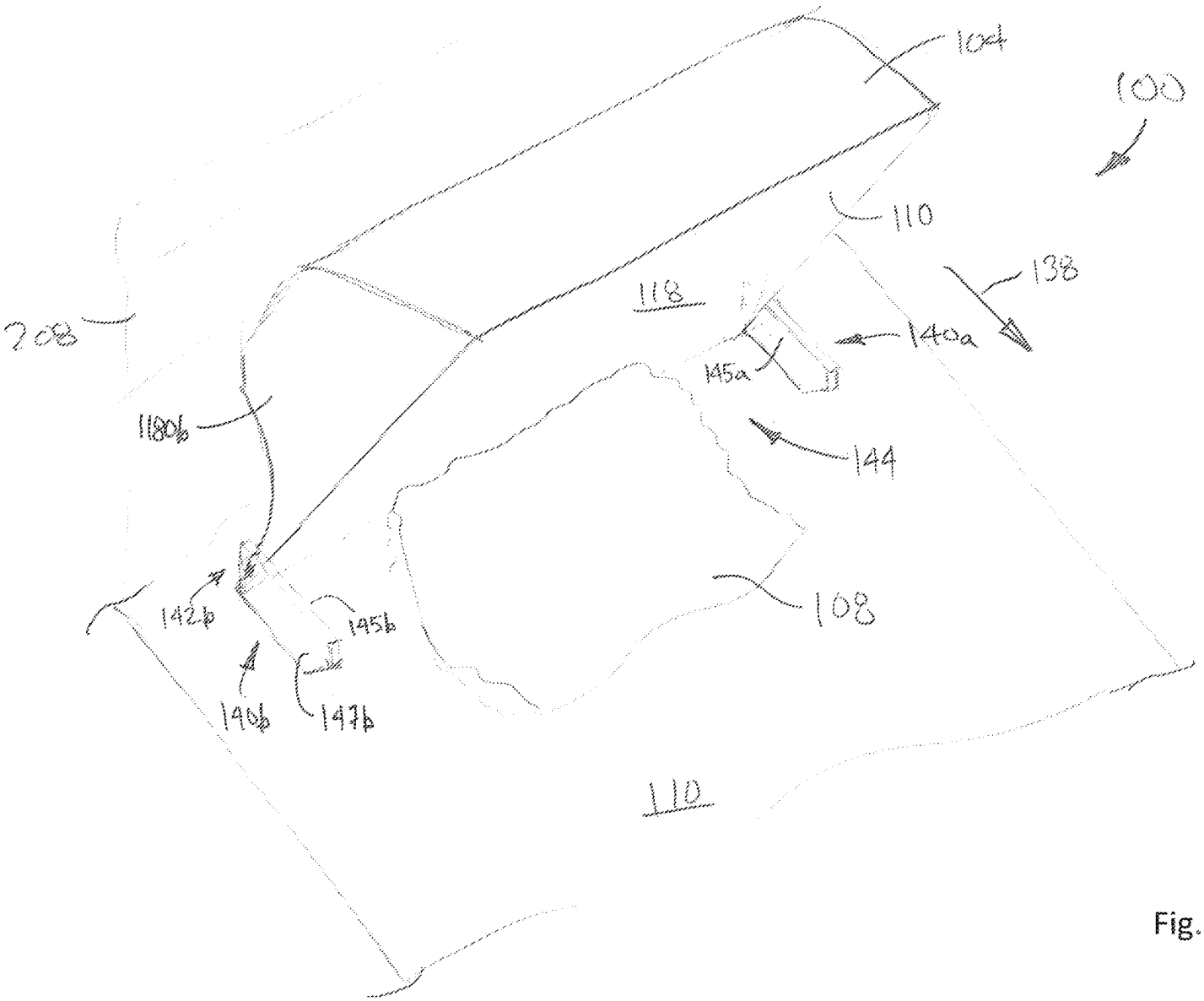
FIG. 5 is an upper rear perspective view of the bucket of FIG. 4.

Tilting the bucket 100 results in movement of the swing plates relative to the bucket main body, and in particular, pivoting of the swing plates away from the first position and toward the second position. Movement of the swing plate relative to the bucket main body 104 toward or into the second position can facilitate aligning the swing plate lower edge 146 with the ground surface when the bottom wall 116 is inclined relative the ground surface (by the tilt angle) and the front edge 120 is moved backward along the ground surface when operating the bucket in the back-dragging mode. In this way, the swing plates 140*a*, 140*b* function to partially enclose an exterior collection space 144 for more efficiently collecting material from the ground surface when operating the bucket 100 in a back-dragging mode. In the example illustrated, the inwardly directed surfaces 145*a*, 145*b* of the swing plates 140*a*, 140*b* cooperate with the outer (lower) surface 118 of the bottom wall 110 of the bucket main body 104 to partially enclose the exterior collection space 144 positioned rearward of bucket bottom wall (see FIG. 5).

Back-dragging can be particularly useful when clearing material from a ground surface near a structure 208 (represented schematically in FIG. 4 as a sectional garage door). Attempting to collect the material near the structure 208 using a forward collection mode, either by advancing the bucket towards the structure (and piling the material against the structure) or by advancing the bucket parallel and as close as possible to the structure, can risk damaging the structure 208. Back-dragging, on the other hand, avoids these risks since the bucket can readily be positioned as shown in FIG. 4, with the front edge positioned (vertically) proximate the ground surface, and (horizontally) near the structure 208, with the bottom wall 116 inclined away from the ground surface. Once in this tilted position, the bucket 100 is moveable in the backward direction (arrow 138) to pull the material 108 away from the structure 208. The swing plates, having moved to or near the second position relative to the bucket main body 104, can improve the efficiency of the back-dragging operation by increasing the amount of material that can be gathered in the back-dragging mode. In the example illustrated, the swing plates 140*a*, 140*b* act as side barriers that reduce the amount of material that would otherwise spill past the sides of the bucket, thereby allowing for a greater amount of material to be collected by the bucket 100 (relative to a bucket without swing plates) in the exterior collection space 144 when the bucket 100 is operated in the back-dragging mode.

Figure 6:
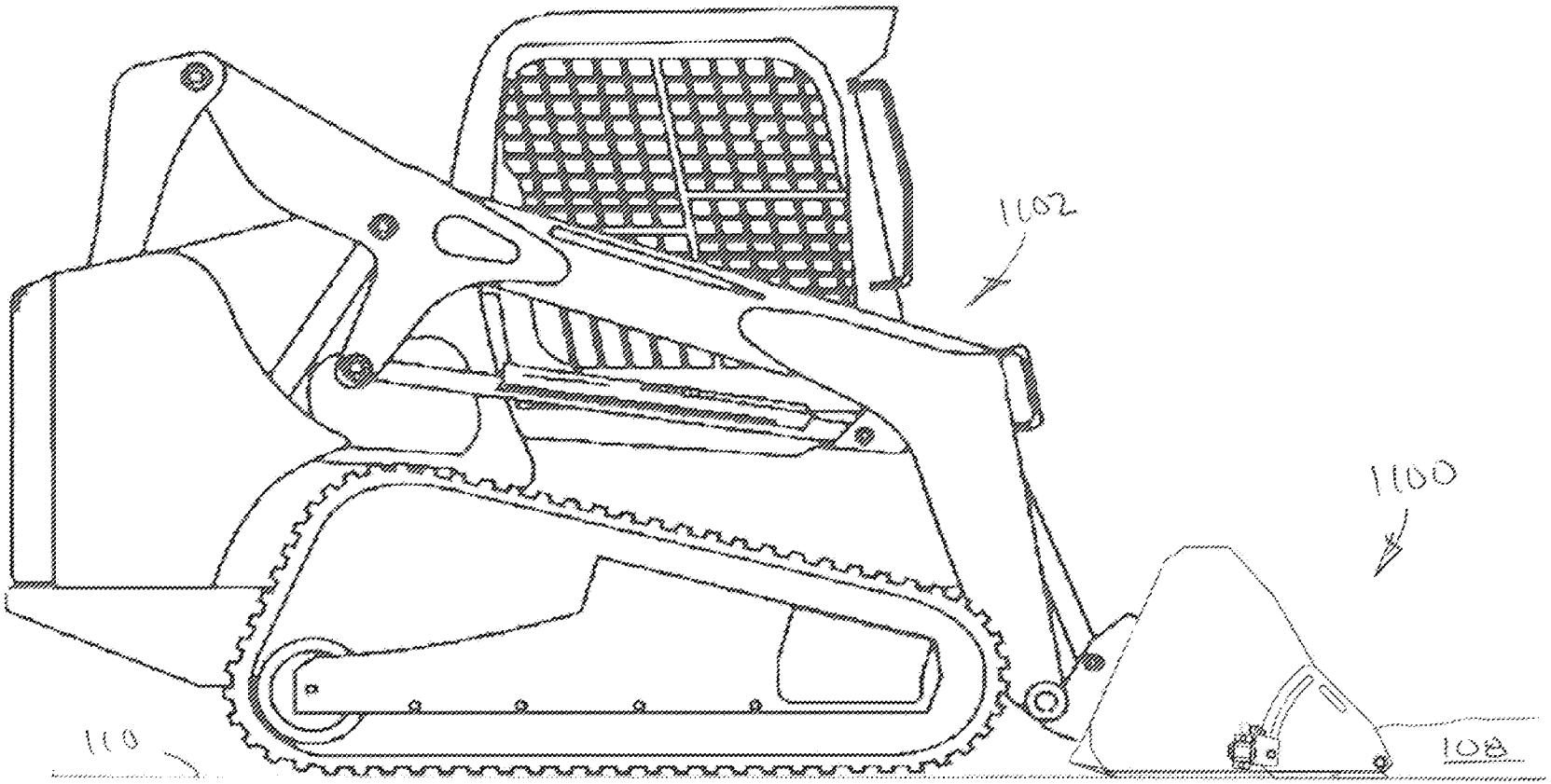
FIG. 6 is a side view of another example of a bucket mounted to a loader.

Referring now to FIG. 6, another example of a bucket 1100 in accordance with aspects of the teaching disclosed herein is shown mounted to a track loader 1102. The bucket 1100 has similarities to the bucket 100, and like features are identified with like reference numerals, incremented by 1000.

Figure 7:
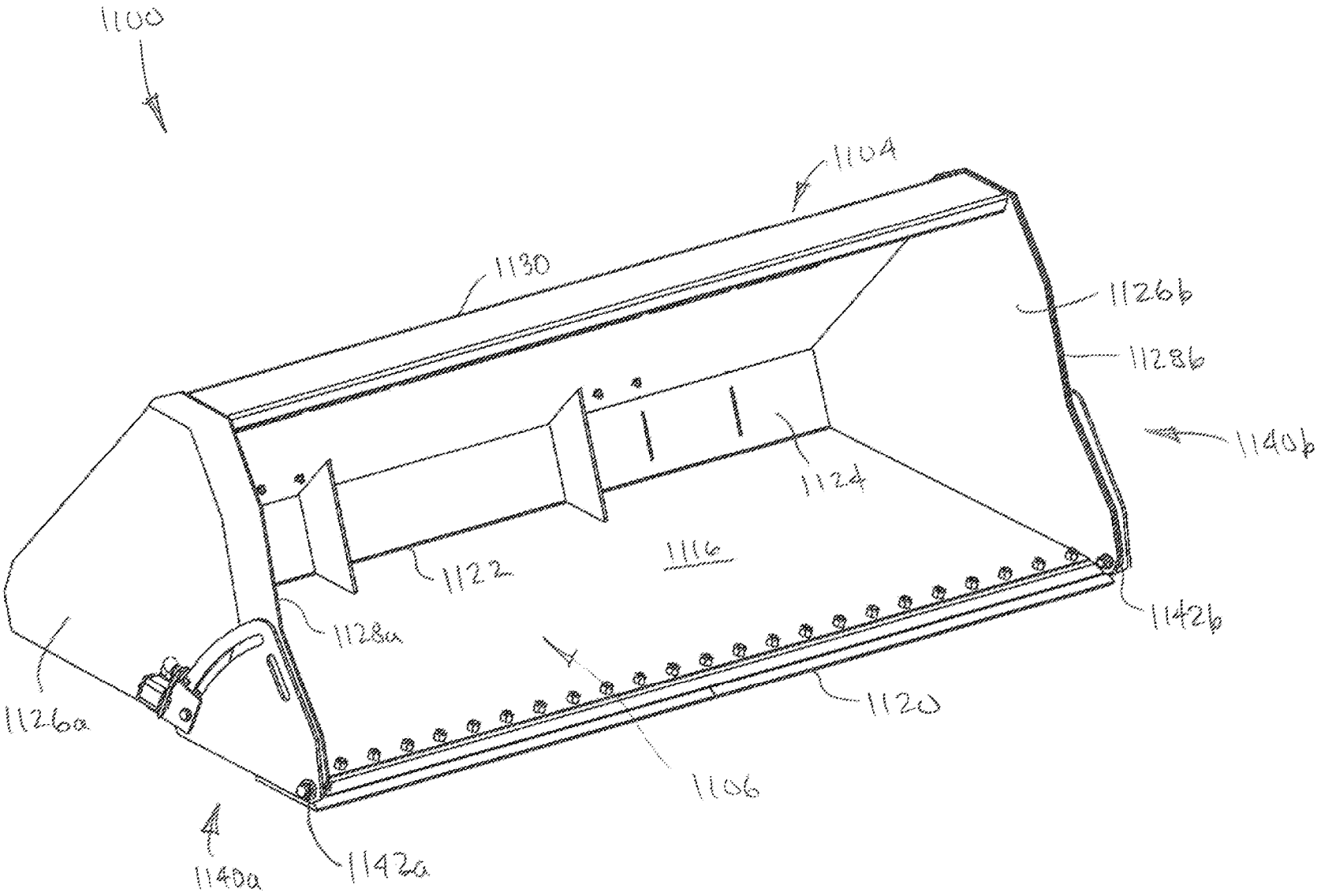
FIG. 7 is an enlarged perspective view of the bucket of FIG. 6.

With reference also to FIG. 7, In the example illustrated, the bucket 1100 has a main body 1104 defining an interior collection space 1106 for collecting material 108 from a ground surface 110 when operating the bucket 1100 in a forward collection mode. The interior collection space 1106 is, in the example illustrated, bounded at least in part by a bottom wall 1116 having a front edge 1120, a back wall 1124 which extends upwardly from the rear edge 1122 of the bottom wall, and a pair of laterally spaced-apart side walls 1126*a*, 1126*b*, the bottom wall and back wall each extending laterally between the side walls 1126*a*, 1126*b*. The sidewalls 1126*a*, 1126*b*, have respective sidewall upper edges 1128*a*, 1128*b*, and the back wall has a back wall upper edge 1130.

The bucket 1100 is further provided with a pair of swing plates 1140*a*, 1140*b*, each of which is pivotably coupled to a respective side of the main body 1104 of the bucket 1100 by a respective pivot joint 142*a*, 142*b*. Each respective pivot joint is located proximate the front edge 1120 of the bottom wall 1116 of the main body 1104. The swing plates 1140*a*, 1140*b* operate to at least partially enclose an exterior collection space 1144 for gathering material from the ground surface when operating the bucket in a back-dragging mode.

In the example illustrated, the swing plate 1140*a* (also called right swing plate 1140*a*) is mounted adjacent the right sidewall 1126*a* of the bucket main body, and the swing plate 1140*b* (also called left swing plate 1140*b*) is mounted adjacent the left sidewall 1126*b* of the bucket main body. The right and left swing plates 1140*a*, 1140*b* are, in the example illustrated, mirror images of each other, and in the following description the features are described for one swing plate (generically referred to as swing plate 1140), and apply in mirror image relation to both swing plates.

Figure 8:
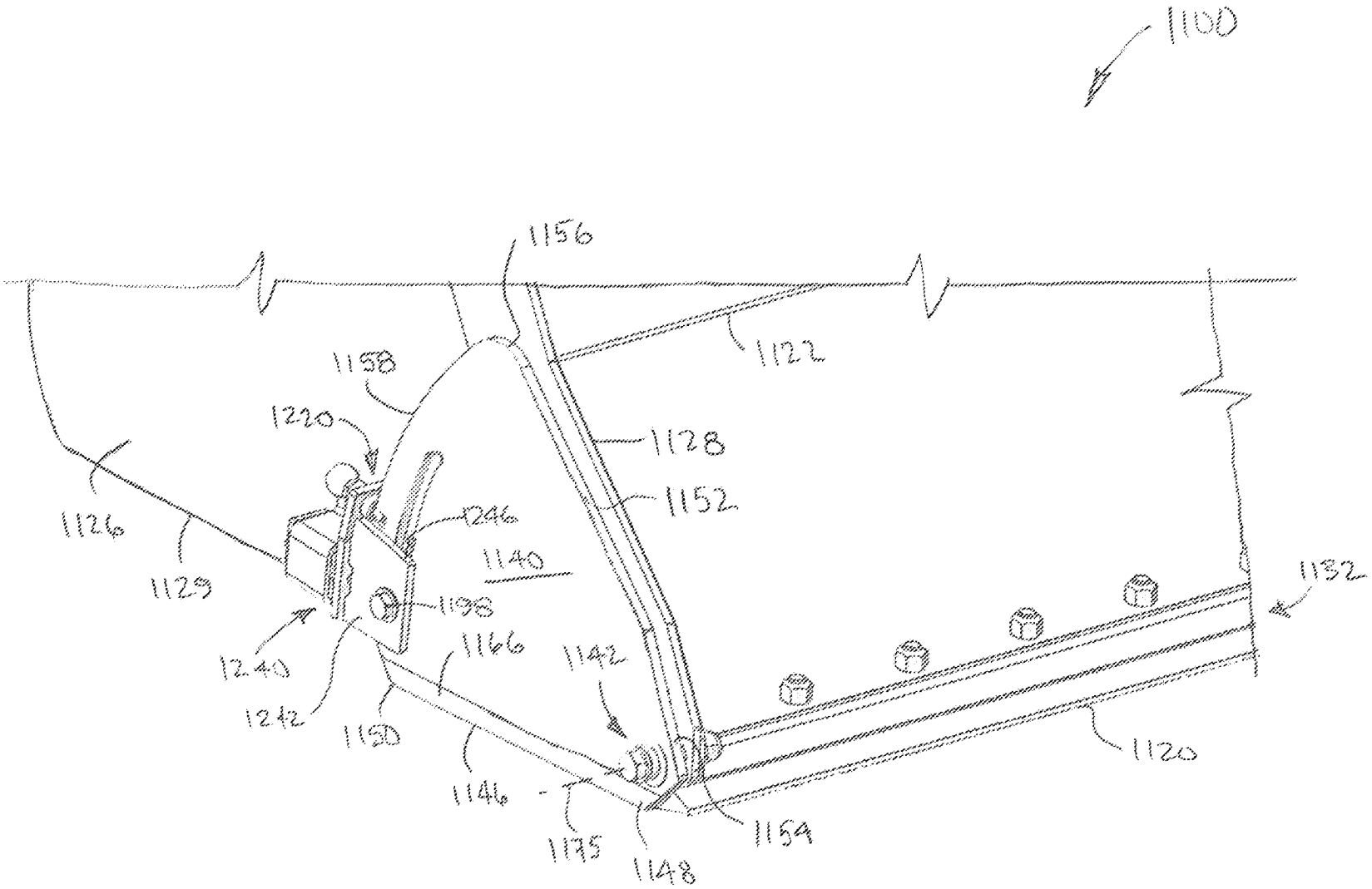
FIG. 8 is an enlarged view of a portion of the bucket of FIG. 7, showing a swing plate of the bucket proximate a first position.

Referring now also to FIG. 8, in the example illustrated, each swing plate 1140 has a swing plate lower edge 1146 extending rearward from a lower edge front end 1148 proximate and below the respective pivot joint 1142 to a lower edge back end 1150. Each swing plate 1140 has a swing plate top edge 1152 extending rearward from a top edge front end 1154 proximate and above the respective pivot joint to a top edge back end 1156. Each swing plate 1140 further has a swing plate back edge 1158 extending between the lower edge back end 1150 and the top edge back end 1156.

In the example illustrated, each swing plate 1140 is generally wedge-shaped or sector-shaped, with the swing plate lower edge 1146 and top edge 1152 converging in a forward direction (toward the pivot joint 1142) and diverging from each other away in a rearward direction (away from the pivot joint 1142). Furthermore, in the example illustrated, at least a substantial portion of the back edge 1154 is shaped as an arc about the pivot axis 1175.

In the example illustrated, each swing plate 1140 includes a runner 1166 extending along the swing plate lower edge 1146. The runner 1166 has a runner width 1168 (see FIG. 12A) that is greater than the adjacent plate thickness 1170 of the swing plate adjacent the runner, and in the example illustrated, the runner width 1168 is between about two and about three times the adjacent plate thickness 1170.

Figure 12C:
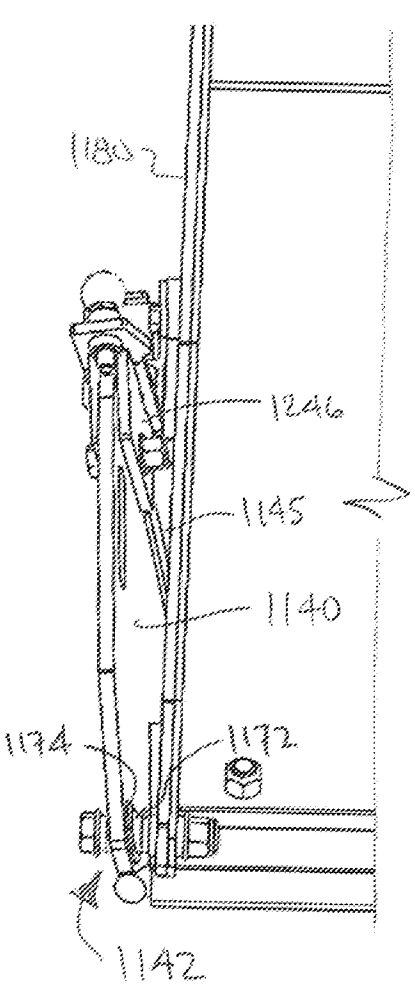
FIG. 12C is front view of the portion of the bucket of FIG. 12A showing the swing plate in a laterally inwardly deflected position.
Figure 12B:
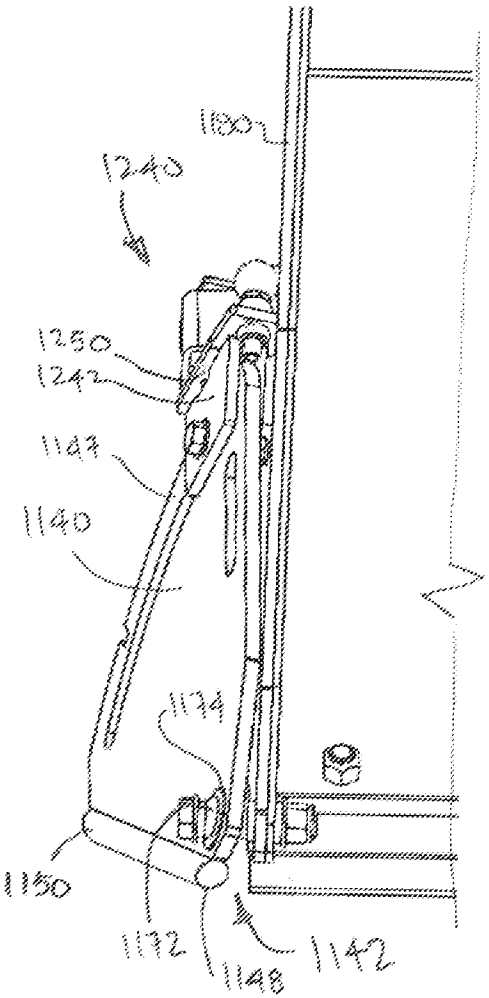
FIG. 12B is a front view of the portion of the bucket of FIG. 12A showing the swing plate in a laterally outwardly deflected position.
Figure 12A:
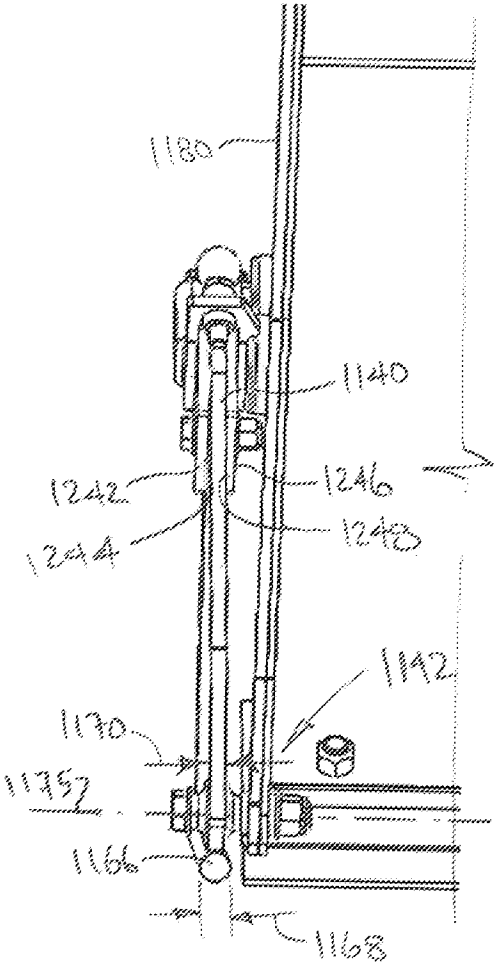
FIG. 12A is a front view of a portion of the bucket FIG. 11, showing a swing plate proximate a second position and in a laterally aligned position.

In the example illustrated, each pivot joint 1142 comprises a ball and socket arrangement that provides pivotability of the swing plate 1140 about a pivot axis 1175 (FIG. 8, 12A) generally aligned with the lateral direction (i.e. parallel to the bucket front edge 1120), and that also provides movability of the swing plate about the joint 1142 in additional directions, for example to accommodate laterally outward and inward deflection of the swing plate 1140 when in or near the second position (FIGS. 12B and 12C). More particularly, each pivot joint 1142 comprises a pivot ball 1172 fixed to the sidewall of the bucket main body. The pivot ball 1172 has an outer spherical surface that is in sliding engagement with an inner spherical surface of a pivot bushing 1174. The inter-engagement of the mating spherical surfaces of the pivot ball 1172 and bushing 1174 inhibits separation of the pivot ball 1172 from the bushing 1174. The pivot bushing 1174 is, in the example illustrated, secured to the swing plate 1140, at a position proximate and above the lower edge front end 1148 of the swing plate.

Figure 9:
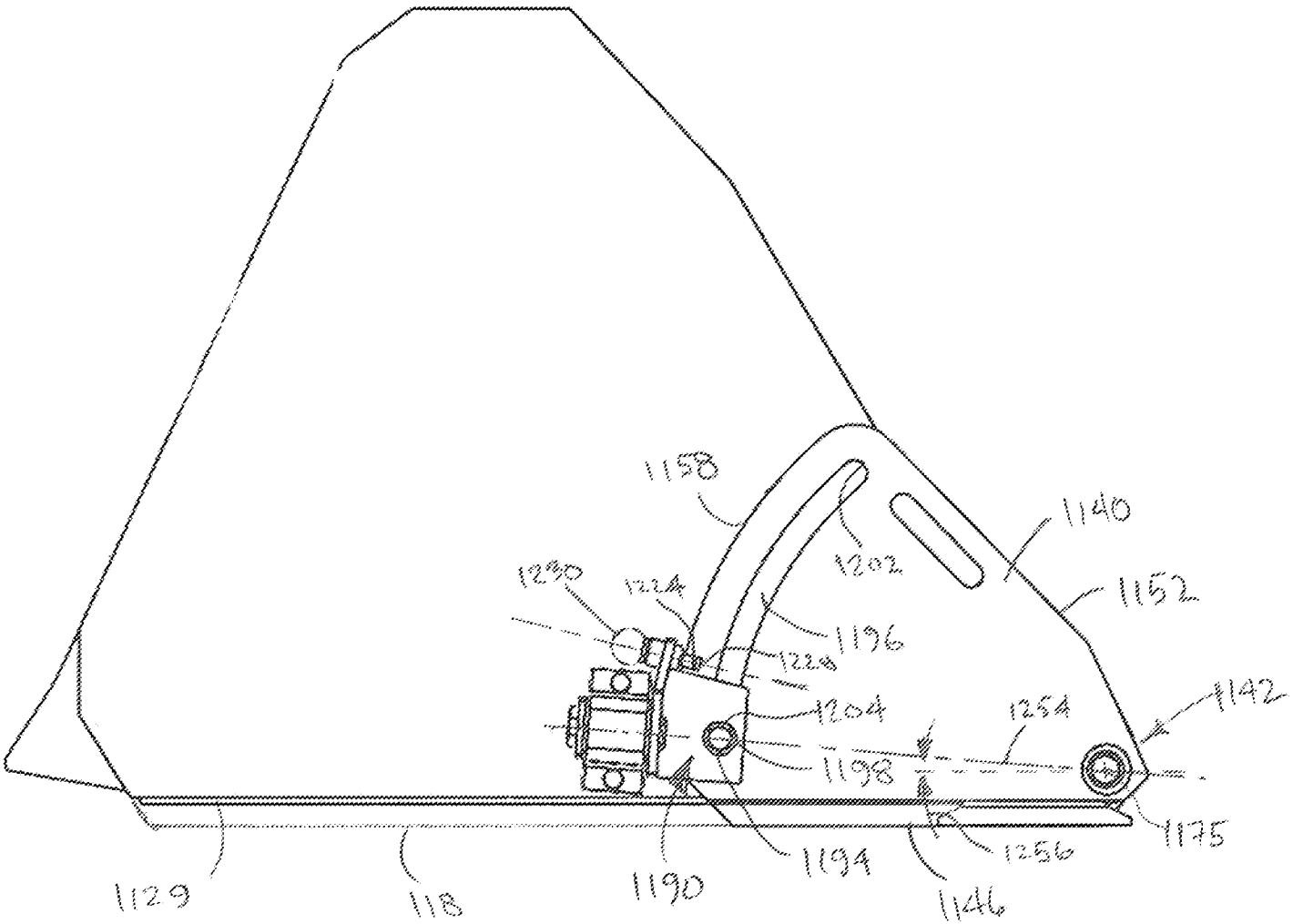
FIG. 9 is a side view of the bucket of FIG. 7, showing a swing plate of the bucket proximate a first position.
Figure 10:
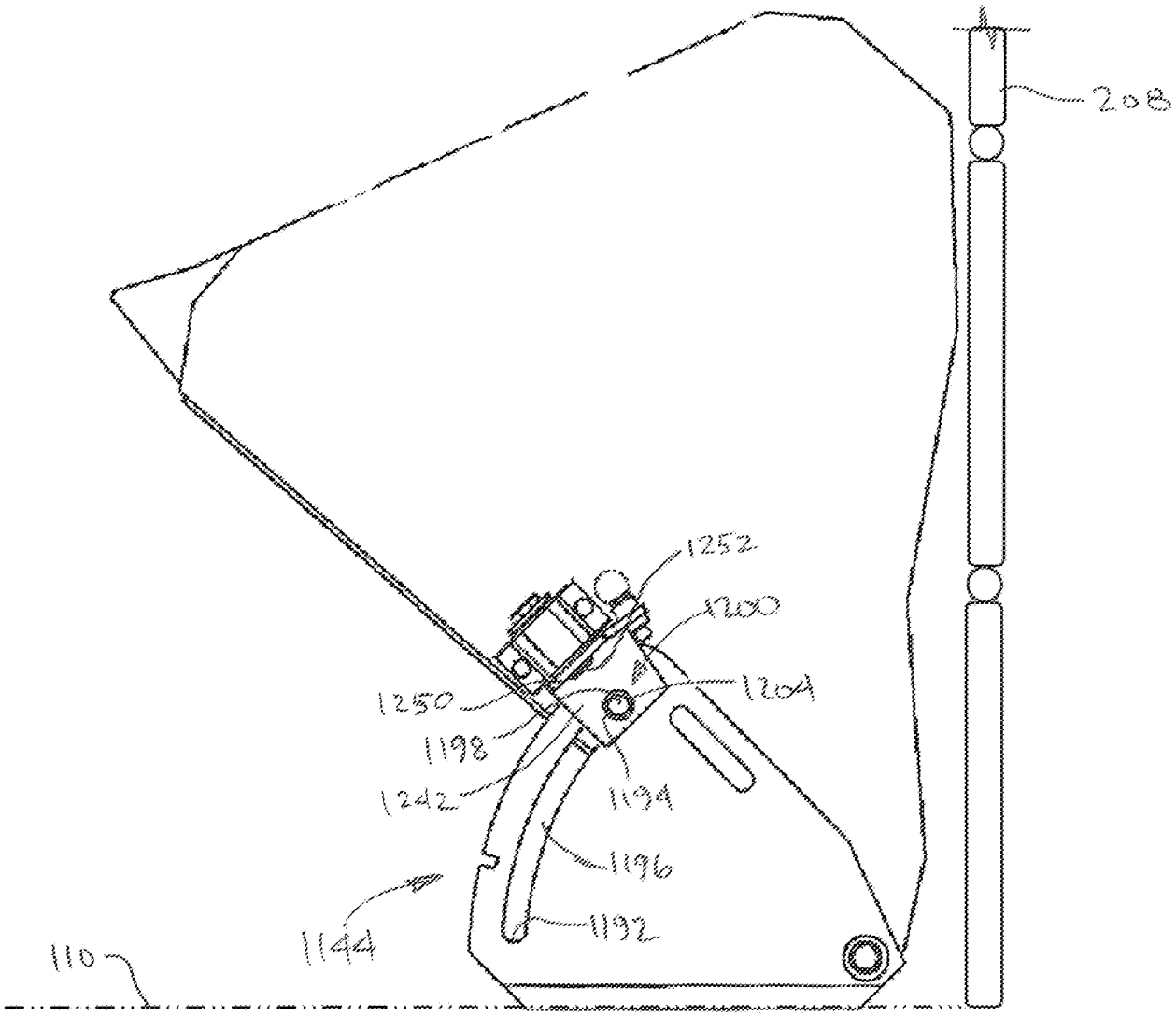
FIG. 10 is a side view of the bucket of FIG. 7 showing a swing plate proximate a second position.
Figure 11:
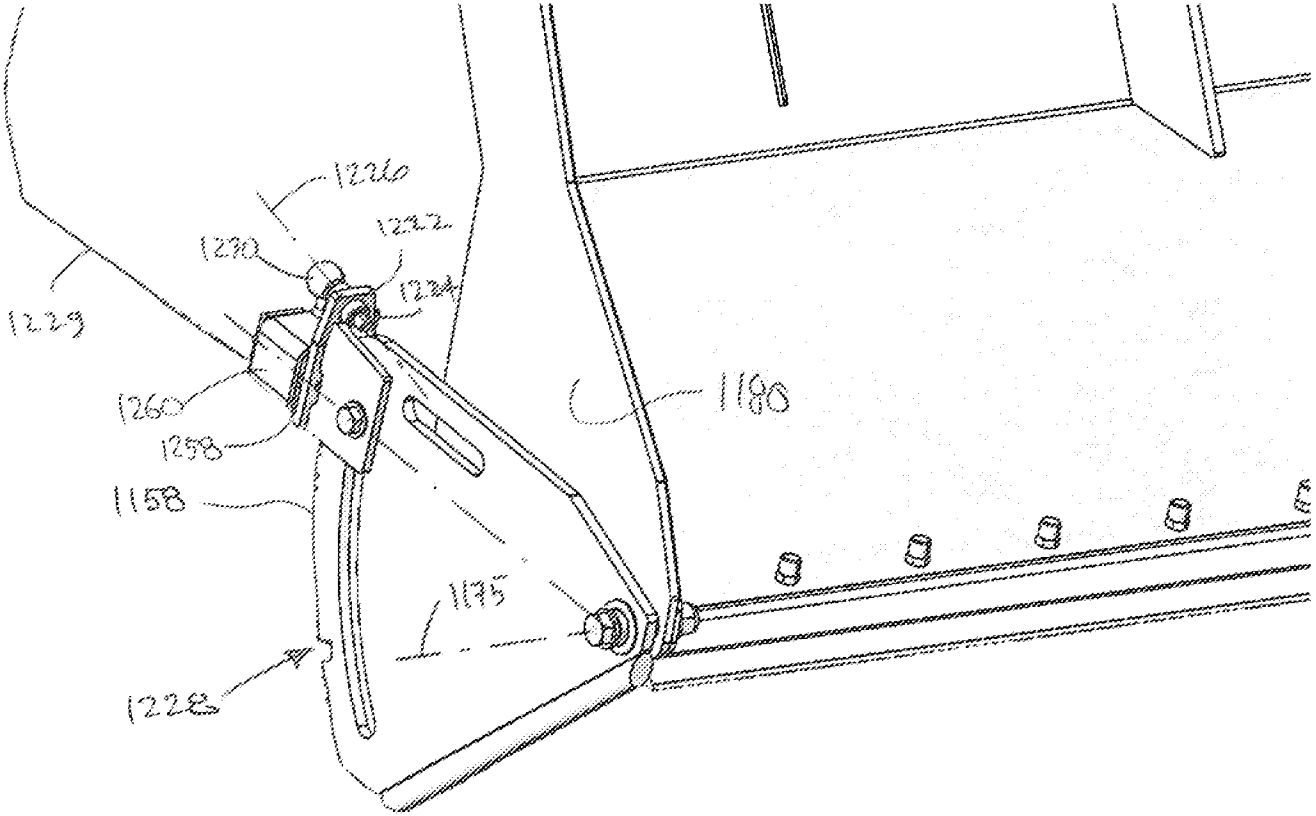
FIG. 11 is a front perspective view of a portion of the bucket of FIG. 10.

With reference to FIGS. 8-11, each swing plate 1140 is pivotable about the pivot axis 1175 relative to the main body 1104 between a first position (shown in FIGS. 8 and 9) and second position (shown in FIGS. 10 and 11). When in the first position, the swing plate lower edge 1146 is generally raised clear of the lower surface 1118 of the bucket bottom wall 1116, such that the swing plate lower edge 1146 does not protrude past (below) the outer surface 1118 of the bucket. In the example illustrated, swing plate lower edge is generally parallel to, and at the same elevation as, the lower surface 118 of the main body bottom wall 116. Providing the ability for each swing plate 1140 to move to a position in which the swing plate generally does not protrude downward past the outer surface 1118 of the bottom wall 1116 of the bucket 1100 facilitates positioning the bottom wall 1116 proximate to, and in parallel alignment with, the ground surface 110 when operating the bucket 1100 in the forward collection mode.

When in the second position, the swing plate lower edge 1146 protrudes past the outer surface 1118 of the bucket bottom wall 1116. In the example illustrated, this is facilitated by providing a second position in which the swing plate is rotated downward (counter-clockwise in FIG. 10) about the pivot axis 1175 by between about 35 degrees and about 70 degrees with respect to a reference position (from the horizontal in FIG. 10). Providing the ability for each swing plate 1140 to move to a position in which the swing plate protrudes downward past the outer surface 1118 of the bottom wall 1116 of the bucket 100 facilitates having the swing plates 1140 function as side containment barriers when operating the bucket 1100 in the back-dragging mode.

In the example illustrated, when the swing plate 1140 is in the first position (FIGS. 8 and 9), the swing plate upper edge 1152 is generally at about the same elevation as, or slightly below, the upper edge 1128 of the sidewall 1126 of the bucket. In other words, the swing plate upper edge 1152 remains generally below (the sidewall upper edge 128 of the respective sidewall when the swing plate is in and moves between the first and second positions. This can help reduce the risk of the swing plates 1140 interfering with operation of the bucket 1100 in the forward collection mode.

Additionally or alternatively, when viewed in side elevation (e.g. FIG. 9), each side wall 1126 has a side wall periphery, and each swing plate 1140 has a swing plate periphery that, in the example illustrated, does not protrude outward of (is generally contained within) the side wall periphery when the swing plates 1140 are in the first position. This can help to inhibit interference of the swing plates 1140 with operation of the bucket 1100 in the forward collection mode.

In the example illustrated, when in or near the second position (e.g. FIG. 10), the top edge 1152 of the swing plate 1140 remains above the outer surface 1118 of the bottom wall 1116 of the bucket main body 1104. Additionally or alternatively, the top edge 1152 of the swing plate 1140 remains above the bottom edge 1129 of the bucket sidewall 1126 when the swing plate is in or near the second position. This can help to avoid providing an open gap above the swing plate top edge 1152 through which material being collected could otherwise escape during back-dragging operation.

In the example illustrated, each swing plate 1140 optionally includes a first position stop 1190 (FIG. 9) coupled thereto for fixing the angular position of the swing plate relative to the bucket main body 1104 when the swing plate is in the first position. Each swing plate 1140 further includes, in the example illustrated, an optional second position stop 1200 (FIG. 10) for fixing the angular position of the swing plate relative to the bucket main body 1104 when the swing plate is in the second position.

In the example illustrated, the first position stop 1190 comprises a first contact surface 1192 (depicted more clearly in FIG. 10) that is generally in fixed position relative to the swing plate, and a first abutment surface 1194 that is generally in fixed position relative to the bucket main body 1104. When the swing plate is in the first position, the first contact surface 1192 bears against the first abutment surface 1194, and further pivoting of the swing plate about the pivot axis 1175 and away from the second position is inhibited. When the swing plate is in the second position, the first contact surface 1192 is spaced apart from the first abutment surface 1194.

In the example illustrated, the first and/or second positions stops 1190, 1200 comprise an arcuate slot 1196 provided in swing plate and a stop pin 1198 coupled to the bucket main body 1104 and slidably received within the arcuate slot 1196. In the example illustrated, the arcuate slot is provided near the swing plate back edge 1158, and is coaxial with the pivot axis 1175. The arcuate slot 1196 extends between opposed closed ends, including a first (lower) closed end (e.g. at 1192) near the swing plate lower edge 1146, and a second (upper) closed end (e.g. at 1202) near the swing plate top edge 1152.

The stop pin 1198 is, in the example illustrated, fixed to a bracket that is mounted to a rear guide mechanism 1240 (described in greater details subsequently herein), and the rear guide mechanism 1240 is mounted to the bucket sidewall 1126. The bracket includes a pair of flanges 1242, 1246 that are spaced apart from each other to receive a rear peripheral portion of the swing plate 1140 (fore and aft of the arcuate slot 1196) therebetween. The stop pin 1198, in the example illustrated, extends between and is fixed to the flanges 1242, 1246. The flanges hold the stop pin a generally lateral orientation (parallel to the bucket front edge 1120), and in a generally fixed position laterally outboard of the bucket sidewall 1126, near the bucket bottom wall 116 and spaced rearward of the pivot axis 1175 by an amount generally equal to the radius of the arcuate slot 1196. The rear guide mechanism allows the bracket/flanges (and stop pin secured thereto) to twist slightly about a deflection axis oriented generally parallel to the lower edge 1129 of the bucket sidewall 1126, and so some movement (a twisting motion) of the stop pin 1198 relative to the bucket sidewall 1126 is possible. But this movement does not materially change the position of the stop pin 1198 relative to the bucket sidewall, so that notwithstanding such twisting, the stop pin 1198 is generally in fixed position relative to the bucket main body 1104.

Referring to FIGS. 9 & 10, in the example illustrated, the stop pin 1198 passes through the slot 1196 generally perpendicular to the swing plate, and slides along the slot length (between closed ends) as the swing plate pivots about the pivot axis 1175. In the example illustrated, the first closed end of the arcuate slot 1196 defines the first contact surface 1192, and a lower surface of the stop pin 1198 facing towards the first closed end defines the first abutment surface 1194. The second closed end of the arcuate slot 1196 defines the second contact surface 1202, and an upper surface of the stop pin facing towards the second closed end defines the second abutment surface 1204.

Referring again to FIGS. 9 and 10, upwards rotation (clockwise in FIG. 9) of the swing plate 1140 about the pivot axis 1175 brings the swing plate into the first position, with the first contact surface 1192 bearing against the first abutment surface 1194. In the example illustrated, the first position corresponds to the reference position in which the swing plate lower edge is parallel to the outer surface 1118 of the bucket bottom wall 116 (i.e. parallel to the horizontal in FIG. 9). Pivoting the swing plate downward (counter-clockwise in FIG. 9) about the pivot axis 1175 brings the swing plate into the second position, with the second contact surface 1202 bearing against the second abutment surface 1204 (see FIG. 10). The total angular travel of swing plate 1140 when pivoting from one to the other of the first and second positions is, in the example illustrated, about 45 degrees.

Referring again to FIG. 8, the bucket 1100 includes, in the example illustrated, an optional lock 1220 mounted to each side of the bucket 1100 for releasably retaining a respective swing plate 1140 in or near the first position. Each lock 1220 comprises a lock housing mounted to the respective sidewall and a latch movably supported by the housing. The lock housing is generally fixed in position relative to the bucket main body 1104, and the latch is movable relative to the housing for engaging and disengaging the swing plate 1140 when the swing plate 1140 is in or near the first position.

In the example illustrated, the lock housing comprises a lock support plate 1222 disposed laterally outboard of the sidewall 1126, near the sidewall lower edge 1129 and spaced slightly rearward of the swing plate back edge 1158. The latch comprises, in the example illustrated, a pin 1224 coupled to the support plate 1222 and translatable relative to the support plate along a lock axis 1226. The pin 1224 is translatable from a retracted position, in which the pin is retracted away from the swing plate back edge 1158, to an advanced position, in which the pin 1224 protrudes forward past the travel envelope of the swing plate back edge 1158 and is seated in a lock notch 1228 provided in the swing plate back edge 1158.

In the example illustrated, the lock axis 1226 is oriented generally parallel to the side wall 1126 (i.e. the lock axis 1226 lies in a plane parallel to, and spaced laterally outboard of, the bucket sidewall 1126). This orientation can help to minimize the amount by which the lock 1220 protrudes laterally outwardly from the bucket main body 1104. In the example illustrated, the lock 1220 further includes a lock actuator in the form of knob 1230 to be grasped by a user for manually moving the lock between locked and unlocked positions.

Referring again to FIG. 8, the bucket 1100 includes a pair of optional rear guide assemblies 1240 for guiding the movement and/or orientation of the swing plates 1140. In the example illustrated, one rear guide assembly 1240 is mounted to each bucket sidewall 1126*a*, 1126*b* for interacting with a respective swing plate 1140*a*, 1140*b*.

In the example illustrated, each rear guide assembly 1240 is configured to facilitate holding the swing plate 1140 in an aligned position, in which the swing plate 1140 is oriented in a generally vertical plane, generally parallel to the bucket sidewall, and orthogonal to the pivot axis 1175. Holding the swing plates 1140 in the aligned position can facilitate smooth movement of the swing plate as it moves partially or fully between the first and second positions.

In the example illustrated, the rear guide assembly 1240 is mounted to the bucket sidewall 1126, near the sidewall lower edge 1129 ??, and rearward of the swing plate edge 1158. The rear guide assembly 1240 includes, in the example illustrated, a pair of forward protruding guide flanges spaced apart from each other to receive a rear peripheral portion of the swing plate adjacent the swing plate back edge 1158 between the guide flanges. The guide flanges include an outer guide flange 1242 having an outer guide flange engagement surface 1244 for sliding engagement with the swing plate outer surface 1147. The guide flanges further include an inner guide flange 1246 having an inner guide flange engagement surface 1248 facing towards the outer guide flange engagement surface 1244 and configured for sliding engagement with the swing plate inner surface 1145.

In the example illustrated, the flanges 1242, 1246 are secured along rearward edges thereof to a base plate 1250. The base plate is mounted to a guide shaft that extends along a guide axis 1254. The guide axis 1254 is near-parallel relative to the sidewall lower edge 1129. In the example illustrated, the guide axis 1254 intersects the pivot axis 1175, and is inclined upward (clockwise in FIG. 9) by a guide angle 1256 in the range of about 2 degrees to about 8 degrees. In the example illustrated, the guide shaft 1252 is twistable about the guide axis 1254, to accommodate outward deflection (FIG. 12B) and inward deflection (FIG. 12C) of the swing plate, relative to the neutral (vertically aligned position—FIG. 12A) intermediate the outward and inward deflected positions. Accommodating inward and/or outward deflection of the swing plates 1140 can help reduce risk of damaging the swing plates in use, upon, for example, encountering an obstacle on the ground surface when operating the bucket 100 in the back-dragging mode.

The rear guide mechanism further includes, in the example illustrated, an optional torsion spring to bias the swing plates to the neutral, aligned position. In the example illustrated, the torsion spring comprises an elastomeric torsion spring 1258 disposed within a spring casing 1260, and coupled to the guide shaft 1252. In the example illustrated, the spring casing 1260 is secured directly or indirectly to the bucket sidewall 1126.

Figure 13:
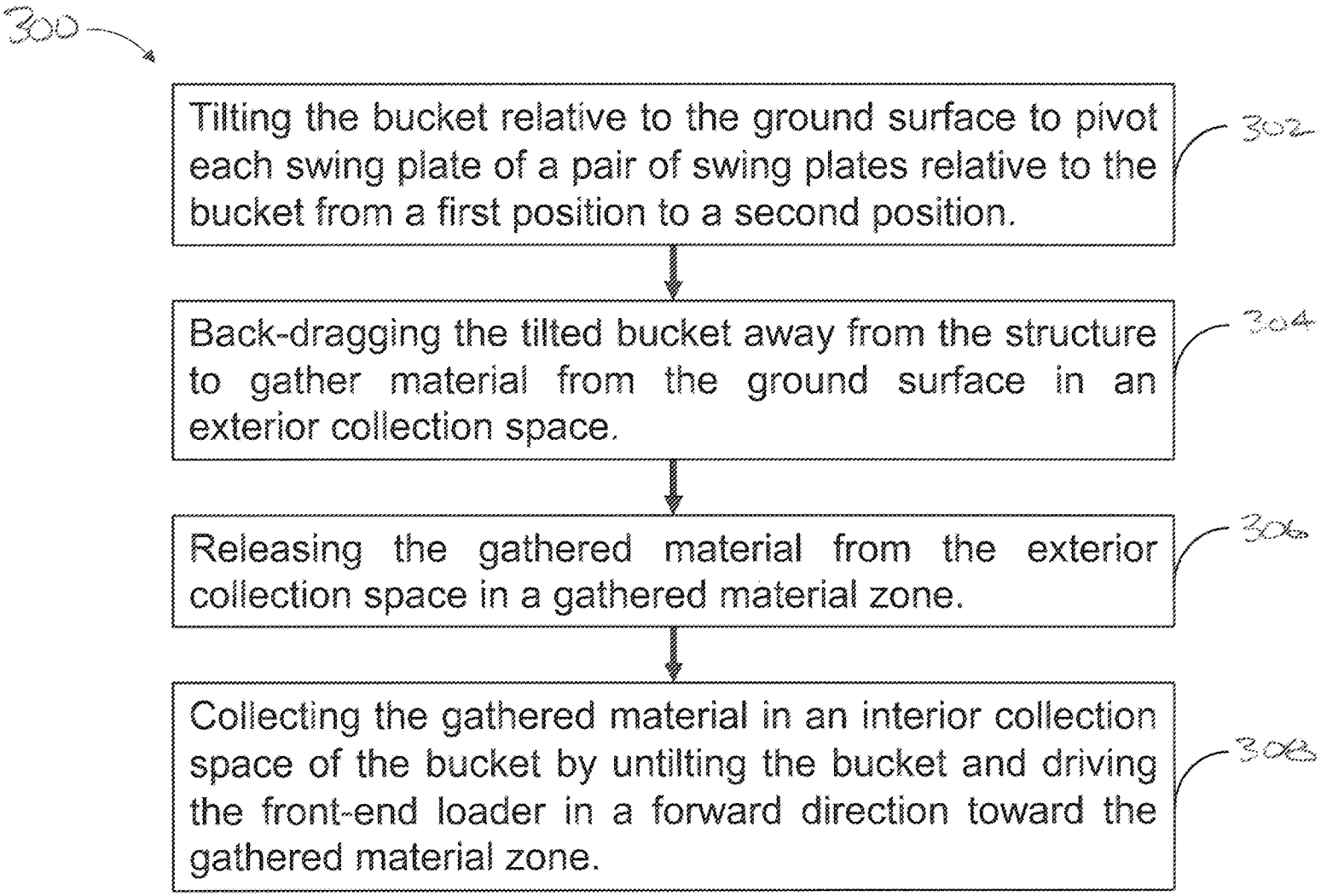
FIG. 13 is a flow chart for a method of operating a loader with a bucket.

Referring now to FIG. 13, an example of a method 300 of operating a loader (e.g. loader 1102) with a bucket 100, 1100 having swing plates 140, 1140 to remove material 108 from a ground surface 110 is depicted.

The method 300 includes a tilting step 302, in which the bucket 100, 1100 is tilted relative to the ground surface 110 so that the bottom wall 116, 1116 of the bucket 100, 1100 is inclined relative to the ground surface 110, with the front edge 120, 1120 of the bucket positioned proximate the ground surface, and a rear edge 122, 1122 of the bottom wall 116, 116 spaced further away from the ground surface. In the example illustrated, the tilting step 302 moves the swing plates 140*a*, 140*b*, 1140*a*, 1140*b* relative to the bucket toward the second position, such that the swing plates protrude past (and behind, in the example illustrated) the outer surface 118, 1118 of the bottom wall 116, 1116 of the bucket.

The method 300 further includes, in the example illustrated, a back-dragging step 304 in which the tilted bucket, with the front edge 120, 1120 proximate the ground surface, is moved in the backwards direction 138, away from, for example, a structure 208. During the back-dragging step, material on the ground surface is gathered in an exterior collection space 144, 1144 that is at least partially enclosed in an axial (travel) direction by the outer surface 118, 1118 of the bucket bottom wall 116, 1116, and in the lateral direction by the opposed inboard faces 145*a*, 145*b*, 1145*a*, 1145*b* of the swing plates 140*a*, 140*b*, 1140*a*, 1140*b*.

The example method 300 further includes a releasing step 306, in which material that has been gathered in the exterior collection space 144, 1144 during back-dragging is released from the exterior collection space, and in particular, is released in a material collection zone. In the example illustrated, the material collection zone is spaced away from the structure 208 a sufficient distance to provide access to the material in the material collection zone by the loader in a forward collection mode. In the example illustrated, releasing the material in step 306 includes raising the bucket away from the ground surface 110.

The method 300 further includes, in the example illustrated, a collecting step 308 in which the material in the material collection zone is collected in the interior collection space 106 of the bucket 100. The collecting step 308 includes, in the example illustrated, un-tilting the bucket so that the bottom wall 116, 1116 is generally parallel with, and proximate to, the ground surface, and advancing the bucket towards the material to urge the material into the interior collection space 106, 1106. Un-tilting the bucket, including bringing the bucket bottom wall 116, 1116 into alignment with, and proximate to, the ground surface, causes movement of the swing plates 140, 1140 relative to the bucket toward the first position.

Depending on the desired volume of material to be removed from the ground surface near the structure, at least one of steps 302, 304, 306, and 308 may be repeated multiple times. Further, at least one of steps 302, 304, 306, and 308 may be repeated multiple times before performing another one of steps 302, 304, 306, and 308. For example, steps 302, 304, and 306 may be repeated multiple times (i.e., any number of back-dragging operations may be performed) before performing a collecting step 308 (i.e., operating the bucket 100, 1100 in the forward collection mode to collect the material in the interior collection space 106, 1106). In some examples, the collecting step 308 may be repeated multiple times after completing step 306. In the example method, the swing plates automatically move back and forth between the first and second positions when switching between the back-dragging step and the collecting step Optionally, after the last performance of the releasing step 306, the swing plates may be releasably secured in the first position by a respective lock 1220, to inhibit interference of the swing plates 140, 1140 with subsequent operation of the bucket in a forward collection mode (e.g. during one or more subsequent collecting steps 308). In some examples, the lock 1220 may comprise a lock pin 1224 that is biased from a retracted position toward an advanced position to automatically secure the swing plates 140, 1140 in the first position when pivoted from the second position to the first position.

What has been described above is intended to be illustrative of examples of the teaching disclosed herein, without limiting the scope of patent claims granted herefrom. The scope of such claims should be given the broadest interpretation consistent with the description as a whole.

What is claimed is:

1. A bucket for a loader comprising:

a main body defining an interior collection space for collecting material from a ground surface when operating the bucket in a forward collection mode, the interior collection space bounded at least in part by a bottom wall having a front edge, a back wall extending upward from a rear edge of the bottom wall, and a pair of laterally spaced-apart side walls, the bottom wall and back wall each extending laterally between the side walls, and the bottom wall extending horizontally along the sidewalls from the rear edge to the front edge for bounding the interior collection space from below; and a pair of swing plates pivotably coupled to respective outboard sides of the main body at respective pivot joints located proximate the front edge of the bottom wall of the main body, each swing plate having a swing plate lower edge extending rearward from a lower edge front end proximate and below the respective pivot joint to a lower edge back end, and each swing plate having a swing plate top edge extending rearward from a top edge front end proximate and above the respective pivot joint to a top edge back end, and each swing plate having a swing plate back edge extending between the lower edge back end and the top edge back end;

each swing plate pivotable relative to the main body between a first position and a second position, wherein when in the first position, the swing plate lower edge of the swing plate is raised above an outer surface of the bottom wall to facilitate aligning the bottom wall with the ground surface when operating the bucket in the forward collection mode, and when in the second position, the swing plate protrudes past the outer surface of the bottom wall for aligning the swing plate lower edge with the ground surface when the bottom wall is inclined relative to the ground surface and the front edge is moved backward along the ground surface when operating the bucket in a back-dragging mode, with inwardly directed faces of the swing plates cooperating with the outer surface of the bottom wall to partially enclose an exterior collection space opposite the interior collection space.

2. The bucket of claim 1, wherein when in the second position, the swing plate top edge of each swing plate remains above the outer surface of the bottom wall of the main body.

3. The bucket of claim 1, wherein the back wall has a back wall upper edge parallel to the front edge of the bottom wall, each side wall has a side wall upper edge extending between the back wall upper edge and the front edge, and when in the first position, the swing plate top edge of each swing plate remains below the respective side wall upper edge.

4. The bucket of claim 1, wherein when in the first position, the swing plate lower edge is generally aligned with or spaced above the outer surface of the bottom wall.

5. The bucket of claim 1, wherein when viewed in side elevation, each side wall has a side wall periphery and each swing plate has a swing plate periphery that is generally contained within the side wall periphery when the swing plate is in the first position to inhibit interference of the swing plate with operation of the bucket in the forward collection mode.

6. The bucket of claim 1 further comprising a rear guide assembly associated with each swing plate to facilitate holding the respective swing plate in an aligned position parallel to the side wall, each rear guide assembly fixed to the side wall near the side wall lower edge, and having guide surfaces to slidably engage opposed contact surfaces of the swing plate near the swing plate back edge when the swing plate is in and moves between the first and second positions.

7. The bucket of claim 6, wherein each pivot joint comprises a ball joint to permit temporary deflection of the swing plate out of the aligned position to a deflected position for preventing damage to the swing plate upon impact with an obstacle, wherein a lower portion of the swing plate is displaced laterally outwardly away from the main body when in the deflected position.

8. The bucket of claim 7, wherein the swing plate is biased to the aligned position.

9. The bucket of claim 8, wherein the rear guide assembly includes an elastomeric torsion spring for biasing the swing plate to the aligned position.

10. The bucket of claim 6, further comprising a respective lock mounted to each side wall for releasably retaining the swing plate proximate the first position.

11. The bucket of claim 10, wherein each lock comprises a pin translatable between advanced and retracted positions along a lock axis oriented generally parallel to the side wall, the pin engaging a notch in the swing plate back edge when the swing plate is in the first position and the pin is in the advanced position.

12. The bucket of claim 1, wherein the bottom wall has a floor surface facing the interior collection space for supporting material collected therein, and the outer surface is on an underside of the bottom wall opposite the floor surface and faces downwardly toward the ground surface in the forward collection mode.

13. The bucket of claim 1, wherein each sidewall projects forward from the back wall to a front end of the sidewall, the front end of each sidewall adjacent the front edge of the bottom wall.

14. The bucket of claim 1, wherein each swing plate is pivotable about a respective pivot joint between the first and second positions.

15. The bucket of claim 1, wherein the bottom wall has an extent from the rear edge to the front edge, and each pivot joint is spaced forward from the rear edge of the bottom wall by about the extent of the bottom wall.

16. A bucket for a loader comprising:

a main body defining an interior collection space for collecting material from a ground surface when operating the bucket in a forward collection mode, the interior collection space bounded at least in part by a bottom wall having a front edge, a back wall extending upward from a rear edge of the bottom wall, and a pair of laterally spaced-apart side walls, the bottom wall and back wall each extending laterally between the side walls, and each sidewall has having a bottom edge extending along the bottom wall from the rear edge to the front edge of the bottom wall; and a pair of swing plates pivotably coupled to respective outboard sides of the main body at respective pivot joints located proximate the front edge of the bottom wall of the main body, each swing plate having a swing plate lower edge extending rearward from a lower edge front end proximate and below the respective pivot joint to a lower edge back end, and each swing plate having a swing plate top edge extending rearward from a top edge front end proximate and above the respective pivot joint to a top edge back end, and each swing plate having a swing plate back edge extending between the lower edge back end and the top edge back end;

each swing plate pivotable relative to the main body between a first position and a second position, wherein when in the first position, the swing plate lower edge of the swing plate is raised above an outer surface of the bottom wall to facilitate aligning the bottom wall with the ground surface when operating the bucket in the forward collection mode, and when in the second position, the swing plate protrudes past the outer surface of the bottom wall for aligning the swing plate lower edge with the ground surface when the bottom wall is inclined relative to the ground surface and the front edge is moved backward along the ground surface when operating the bucket in a back-dragging mode, with inwardly directed faces of the swing plates cooperating with the outer surface of the bottom wall to partially enclose an exterior collection space opposite the interior collection space.

17. A bucket for a loader comprising:

a main body defining an interior collection space for collecting material from a ground surface when operating the bucket in a forward collection mode, the interior collection space bounded at least in part by a bottom wall having a front edge, a back wall extending upward from a rear edge of the bottom wall, and a pair of laterally spaced-apart side walls, the bottom wall and back wall each extending laterally between the side walls, and wherein the bottom wall is generally planar and alignable parallel with the ground surface for the forward collection mode; and a pair of swing plates pivotably coupled to respective outboard sides of the main body at respective pivot joints located proximate the front edge of the bottom wall of the main body, each swing plate having a swing plate lower edge extending rearward from a lower edge front end proximate and below the respective pivot joint to a lower edge back end, and each swing plate having a swing plate top edge extending rearward from a top edge front end proximate and above the respective pivot joint to a top edge back end, and each swing plate having a swing plate back edge extending between the lower edge back end and the top edge back end;

each swing plate pivotable relative to the main body between a first position and a second position, wherein when in the first position, the swing plate lower edge of the swing plate is raised above an outer surface of the bottom wall to facilitate aligning the bottom wall with the ground surface when operating the bucket in the forward collection mode, and when in the second position, the swing plate protrudes past the outer surface of the bottom wall for aligning the swing plate lower edge with the ground surface when the bottom wall is inclined relative to the ground surface and the front edge is moved backward along the ground surface when operating the bucket in a back-dragging mode, with inwardly directed faces of the swing plates cooperating with the outer surface of the bottom wall to partially enclose an exterior collection space opposite the interior collection space.

* * * * *